US011548665B2

(12) United States Patent
Wittorf et al.

(10) Patent No.: US 11,548,665 B2
(45) Date of Patent: Jan. 10, 2023

(54) METHOD FOR FILLING A MEDICAL PACKAGING, FILLING DEVICE, AND MEDICAL PACKAGING FORMED AS A POUCH

(71) Applicant: FRESENIUS KABI DEUTSCHLAND GMBH, Bad Homburg (DE)

(72) Inventors: Joern Wittorf, Friedberg (DE); Gerald Wegner, Friedberg (DE); Witali Klan, Friedberg (DE); Marius Ruffer, Friedberg (DE); Stefan Faber, Friedberg (DE); Denis Kosatsch, Friedberg (DE); Behnam Zandnia, Friedberg (DE)

(73) Assignee: Fresenius Kabi Deutschland GmbH, Bad Homburg (DE)

( * ) Notice: Subject to any disclaimer, the term of this patent is extended or adjusted under 35 U.S.C. 154(b) by 228 days.

(21) Appl. No.: 16/646,837

(22) PCT Filed: Sep. 21, 2018

(86) PCT No.: PCT/EP2018/075647
§ 371 (c)(1),
(2) Date: Mar. 12, 2020

(87) PCT Pub. No.: WO2019/057918
PCT Pub. Date: Mar. 28, 2019

(65) Prior Publication Data

US 2020/0270003 A1 Aug. 27, 2020

(30) Foreign Application Priority Data

Sep. 22, 2017 (EP) ..... 17192684

(51) Int. Cl.
*A61J 1/14* (2006.01)
*B65B 3/00* (2006.01)
(Continued)

(52) U.S. Cl.
CPC ..... *B65B 3/003* (2013.01); *A61J 1/10* (2013.01); *A61J 1/1431* (2015.05); *A61J 1/1462* (2013.01);
(Continued)

(58) Field of Classification Search
CPC ..... B65B 3/003; B65B 31/024; B65D 1/095; A61J 1/10; A61J 1/1431; A61J 1/1462;
(Continued)

(56) References Cited

U.S. PATENT DOCUMENTS 4,973,327 A * 11/1990 Goodrich, Jr ..... A61J 1/10 604/408
8,720,496 B2 5/2014 Huwiler et al.
(Continued)

FOREIGN PATENT DOCUMENTS

WO 2007114759 10/2007
WO 2008115548 9/2008
(Continued)

*Primary Examiner* — Nicolas A Arnett
(74) *Attorney, Agent, or Firm* — Occhiuti & Rochlicek LLP

(57) ABSTRACT

The invention relates to a method and to a device for filling a medical packaging formed as a pouch. Preferably, the packaging is filled with liquid via a port, wherein the port is aerated with a protective gas, such as nitrogen, for example, during filling According to the invention, prior to filling with liquid, the packaging is filled with an inert gas, such as nitrogen, for example, which then provides the headspace of the filled and closed pouch. This results in a particularly low oxygen content in the headspace of the pouch.

20 Claims, 9 Drawing Sheets

(51) Int. Cl.

| | |
|---|---|
| ***A61J 1/10*** | (2006.01) |
| ***A61J 1/16*** | (2006.01) |
| ***A61J 1/20*** | (2006.01) |
| ***B65D 1/09*** | (2006.01) |
| ***B65B 31/02*** | (2006.01) |

(52) U.S. Cl.
CPC ..... *A61J 1/1468* (2015.05); *A61J 1/1481* (2015.05); *A61J 1/16* (2013.01); *A61J 1/20* (2013.01); *B65B 31/024* (2013.01); *B65D 1/095* (2013.01)

(58) Field of Classification Search
CPC ..... A61J 1/1468; A61J 1/1481; A61J 1/16; A61J 1/20; A61J 1/1475
See application file for complete search history.

(56) References Cited

U.S. PATENT DOCUMENTS 10,532,837 B2 * 1/2020 Baud ..... B65B 67/1233
10,974,856 B2 * 4/2021 Prestine ..... B65B 65/02
2006/0194009 A1 * 8/2006 Tajima ..... B29C 66/81267 428/35.2
2008/0234652 A1 * 9/2008 McCarthy ..... A61P 7/08 604/410
2008/0234653 A1 * 9/2008 McCarthy ..... A61B 50/10 604/416
2008/0234654 A1 * 9/2008 McCarthy ..... A61P 7/08 604/416
2010/0006175 A1 * 1/2010 Shinagawa ..... B65B 3/22 141/7
2010/0288394 A1 * 11/2010 Larsen ..... B65B 43/465 141/10
2011/0108158 A1 * 5/2011 Huwiler ..... A61M 5/14244 141/2
2016/0015599 A1 * 1/2016 Gentile ..... A61M 5/1486 222/1
2016/0068293 A1 * 3/2016 Cutting ..... A01N 1/0252 53/432
2016/0176615 A1 * 6/2016 Harada ..... B65D 83/40 141/8
2020/0270003 A1 * 8/2020 Wittorf ..... A61J 1/1462

FOREIGN PATENT DOCUMENTS

WO 2014140494 9/2014
WO 2014147159 9/2014

* cited by examiner

METHOD FOR FILLING A MEDICAL PACKAGING, FILLING DEVICE, AND MEDICAL PACKAGING FORMED AS A POUCH

CROSS REFERENCE TO RELATED APPLICATION

This application is the national phase under 35 USC 371 of international application no. PCT/EP2018/075647, filed Sep. 21, 2018, which claims the benefit of the Sep. 22, 2017 priority date of European application no. 17192684.3.

FIELD OF THE INVENTION

The invention relates to a method for filling a medical packaging configured as a pouch. In particular, the invention relates to a method for filling pouches with an infusion liquid, for example a liquid containing an active agent or a liquid for parenteral feeding. The invention further relates to a device for filling a medical packaging configured as a pouch and to a medical packaging configured as a pouch, which medical packaging is filled with an infusion liquid.

BACKGROUND OF THE INVENTION

Prefilled medical packagings configured as pouches are known from practice. These are here, in particular, in the form of pouches which are filled, for example, with a liquid containing an active agent or with a liquid for parenteral feeding. A pouch of this type has at least one port. In general, the port comprises a septum which can be pierced with a spike or with a needle in order to remove liquid from the pouch.

When a pouch is filled, a residual volume of gas generally remains in the inner volume of the pouch. Depending on what sort of a liquid is present in the pouch, this residual volume should contain as little oxygen as possible, since otherwise an active agent can decompose or a liquid for parenteral feeding can decay.

It is therefore known from practice to bubble nitrogen into the support liquid, in particular water, used to fill the pouch. As a result, the oxygen present in the liquid is largely replaced by nitrogen.

Since the foils used for medical packagings configured as pouches can have a reduced barrier effect with respect to oxygen, it is also known from practice to introduce the pouch into a secondary pouch comprising an oxygen barrier.

It is further known from practice to insert into the secondary pouch an oxygen absorber, such as, for instance, an insert which contains iron filings and via which the residual oxygen which is present in or might possibly infiltrate the primary pouch shall be removed. The introduction of such oxygen absorbers is technically complex and expensive.

OBJECT OF THE INVENTION

The object of the invention is to provide a method and a device for filling a medical packaging preferably configured as a pouch, in which method a low residual oxygen content in the remaining gas volume of the pouch or of the packaging is obtainable.

The invention further relates to the provision of a medical packaging, configured as a pouch, in which the introduction of an oxygen absorber into the secondary packaging can be dispensed with, even if the contents are sensitive to oxygen.

SUMMARY OF THE INVENTION

The object of the invention is achieved by a method for filling medical packaging configured as a pouch, by a device for filling a medical packaging configured as a pouch, and by a medical packaging, configured as a pouch, as part of a pharmaceutical product according to one of the independent claims.

Preferred embodiments and refinements of the invention can be derived from the subject of the dependent claims, the description and the drawings.

The invention firstly relates in general terms to a method for filling medical packaging configured as a pouch. In particular, the invention relates to a method with which pouches are filled with a liquid containing active agent or with a liquid for parenteral feeding.

The present invention is described by a method for filling a medical packaging preferably configured as a pouch, wherein the packaging is filled with a liquid via an entrance and the entrance, during the filling process, is provided in a protective atmosphere, characterized in that the packaging, prior to being filled with the liquid, is filled with an inert gas. Preferably, for the provision of the protective atmosphere, at least one opening extends, at least in some sections, around the gas nozzle. A locally bounded protective atmosphere can thereby be provided.

The filling is part of the production process of a pharmaceutical product. The aforementioned filling method can therefore also be described as a method for producing a pharmaceutical product, in which a medical packaging, preferably configured as a pouch, is filled, wherein the packaging is filled with a liquid via an entrance and the entrance, during the filling process, is provided in a protective atmosphere, characterized in that the packaging, prior to being filled with the liquid, is filled with an inert gas.

The packaging is configured in particular as a foil pouch. According to one embodiment of the invention, this is in the form of a pouch made up of two welded together polyolefin foils, in particular polypropylene foils. The foils can be of single-layered or else multilayered construction. In general, the polyolefin-containing layers provide the inner layers, which are in contact with the liquid.

The pouch comprises at least one port, via which the pouch can be or is filled with liquid. Preferably, the port also serves for the removal of liquid. In the finished state of the pouch, the port can have a septum for seal-off purposes, which septum can be pierced by introduction of a spike or a needle. Preferably, the port is a component produced by injection molding. The port can, however, also be provided by a simple section of hose.

In one embodiment of the invention, the port is welded in place between the foils. In particular, this can be a port having a tapered welding shuttle which is welded into a weld seam of the pouch.

According to the invention, the pouch is filled with a liquid via an entrance, wherein the entrance, during the filling process, is provided in a, preferably locally bounded, protective atmosphere. The protective gas is a gas which displaces oxygen and/or does not react with the liquid to be packaged. For instance, the protective gas is or comprises an inert gas. Preferably, the protective gas comprises or is nitrogen. Preferably, the pouch is filled by means of a liquid nozzle.

The entrance in or to the pouch can be provided, for example, via an opening in the weld seam. In a preferred embodiment of the invention, the entrance is provided by the port. The pouch is filled with liquid via a liquid nozzle, wherein the port, in particular a filler opening of the port, is gassed with the protective gas, preferably nitrogen, during the filling process.

It is in particular provided that in the region of the entrance, preferably the filler opening of the port, a laminar flow of the protective gas is generated, so that the filling takes place in the protective atmosphere which extends around the liquid nozzle and the filler opening of the port. The locally bounded protective atmosphere can here be provided as a displacement flow. Preferably, the protective gas flow runs, at least in part, vertically from top to bottom.

According to the invention, the packaging, in particular the pouch, prior to being filled with liquid, is filled with an inert gas. Besides a gassing of the region of the filler opening, for example a port, for the provision of a protective atmosphere, an inert gas is thus additionally, prior to the filling, actively passed into the medical packaging configured as a pouch. Preferably, the filling of the inert gas is realized by means of a gas nozzle, to which in particular the filler opening of the entrance, for example the port, of the pouch is docked. Preferably, for the provision of the protective atmosphere, there is provided at least one opening, which extends, at least in some sections, around the liquid nozzle and/or the gas nozzle.

It has been shown that, by the filling of the pouch with the inert gas, the residual oxygen content in the remaining gas volume of the filled and sealed pouch can be reduced in an amazingly efficient manner. The atmosphere of the headspace of the filled and sealed pouch is hence already provided beforehand in the not yet filled pouch, although the actual filling of the pouch with the liquid is only performed afterward.

In one embodiment of the invention, the packaging is filled with a volume of inert gas which corresponds to at least the volume of a gas volume remaining after filling of the packaging. At least or substantially that quantity of inert gas whose volume is at least as large as that gas volume or residual volume in the packaging that remains after the end of the filling operation is thus introduced. In particular, a volume of inert gas, preferably nitrogen, of 10 to 50 ml, preferably of 15 to 30 ml, is fed in.

It is hereby achieved that, when the packaging is filled with the liquid, a gas volume in the form of the inert gas is perhaps already present in the packaging, which gas volume corresponds to the remaining gas volume.

In one embodiment, the inert gas is at least one gas which is selected from a group consisting of nitrogen, argon, helium, neon and carbon dioxide.

Preferably, nitrogen is used as the inert gas. For it serves, inter alia, to displace the oxygen, and thereby, as far as possible, prevent oxidation of the content.

Preferably, the pouch, prior to being filled with the inert gas, is evacuated. The evacuation is preferably realized via the gas nozzle, to which the pouch, in particular the filler opening of the entrance or port of the pouch, is docked. The packaging is preferably evacuated to a pressure of below 300 mbar, preferredly of below 100 mbar, particularly preferredly of below 50 mbar.

Preferably, during the filling with the liquid, neither is gas released from the inner volume of the pouch, nor is gas introduced. In this way, the filler opening of the pouch entrance or of the port can be docked sealingly to the liquid nozzle. No turbulence is generated by entering or exiting gas, which turbulence could in turn result in the entry of air or oxygen in the region of the filler opening.

According to a further embodiment of the invention, the medical packaging configured as a pouch is firstly checked for leak-tightness, in that it is firstly evacuated and, following termination of the negative pressure, it is checked whether a rise in pressure ensues due to a leak in the packaging.

Next, in a second step, preferably with yet higher negative pressure, the packaging is evacuated and then filled with the inert gas.

In one embodiment of the invention, the packaging is filled with the liquid using a filing head. Preferably, the filling head has a gas nozzle and a liquid nozzle. During the filling operation, the packaging is firstly docked to the gas nozzle and, after having been filled with inert gas, preferably nitrogen, is transferred to the liquid nozzle. The liquid nozzle and/or the gas nozzle respectively bear sealingly against the filler opening of the entrance, for example the port, of the pouch.

Preferably, both the gas nozzle and the liquid nozzle are continuously gassed with the protective gas in order to provide the protective atmosphere.

According to a further embodiment of the invention, the entrance, in particular the port, of the pouch, upon the transfer of the packaging from the gas nozzle to the liquid nozzle, is shut off, preferably clamped shut. In this way, gas is prevented from flowing in or being forced out during the transfer, for instance due to deformations of the pouch which are formed by arising forces in the course of the transfer.

For the shutting-off, preferably clamping of the pouch, a squeezing pincer, in particular, is used. Preferably, the pouch is clamped shut with the squeezing pincer, in that the bearing surface of a jaw of the closed squeezing pincer surrounds the welded portion of a port and reaches at least up to a weld seam of the pouch. In a preferred embodiment of the invention, the squeezing pincer, in particular a jaw of the squeezing pincer, is of substantially U-shaped configuration and clamps shut the foil around the welded region of the port. The port itself thus does not have to be clamped shut in this way. A clamping of the foils lying one above the other and adjoining the port has the advantage that volume changes to the inner volume of the pouch do not here materialize, or only to a minor extent. Such volume changes could lead to pumping effects, which, in turn, can necessitate an injection of oxygen.

In another embodiment of the invention, the port itself can also however have a region which is squeezed in order to shut off, i.e. temporarily close off, the port, before and/or after the filling operation.

Preferably, the packaging, after having been filled with the liquid, is moved to a sealing device, in which the entrance is then sealed. For example, the entrance can be sealed by welding, in particular of an opening in the weld seam. According to a preferred embodiment of the invention, the pouch is moved to a seal and sealed by mounting of the seal onto the port.

The seal can in particular be in the form of a snap-on seal. This can in particular be in the form of a seal configured as a cap, which seal is already provided with a pierceable septum and in particular is sealed with a break-off part.

The seal is preferably applied in a fully automated manner by the sealing device, which has a seal receptacle. Preferably, the seal is gassed with a protective gas, for instance nitrogen, before and/or during the mounting operation. In detail, the interior of the seal is purged with the protective gas. Any oxygen which may be present can thereby be displaced.

Preferably, the entrance or port, in particular in the region of the filler opening, is gassed with a protective gas, for instance nitrogen, during the mounting of the seal. It is in particular provided that the entrance or port is first docked to the gas nozzle. The pouch is then evacuated and filled with the inert gas. Next, the pouch is transferred to the liquid nozzle and filled. Finally, the pouch is transferred to a sealing device or seal receptacle, where the entrance is sealed, in particular the seal is mounted. It should herein be emphasized that preferably less than a second elapses between the filling and sealing of the pouch. A filling process can hence be realized outside of a sterile room. Both during the docking to the gas nozzle and liquid nozzle, and during the movement from the gas nozzle to the liquid nozzle, and during the transfer to the sealing device and the mounting of the seal, the entrance, in particular the port, is continuously gassed with a protective gas, preferably nitrogen. The gassing is realized, in particular, by generation of a laminar protective gas flow around the entrance or around the port, in particular the filler opening of the entrance or port.

Preferably, the pouch is shut off, preferably clamped shut, also during the movement to the sealing device, in particular the seal receptacle. In particular, the pouch, prior to being undocked from the liquid nozzle, is shut off, and then moved to the sealing device, where the entrance is sealed. In particular, the pouch, prior to being undocked from the liquid nozzle, is clamped shut and then moved to the seal receptacle, where the seal is mounted, in particular snapped on. The filling operation is then at an and. The squeezing pincer can be opened and the pouch ejected.

In a preferred embodiment of the invention, the packaging is filled in hanging suspension. The pouch is preferably oriented such that the filler opening, in particular of the port, is directed upward during filling with the inert gas and during filling with the liquid.

In a further embodiment of the invention, after the filling of the packaging, liquid which is present at the liquid nozzle, for instance a droplet which is present, is withdrawn, for example by application of a negative pressure in the liquid line.

Preferably, the liquid, for instance the droplet, is withdrawn such that, after the withdrawal, a rim of the liquid nozzle is still in contact with the liquid. There is not so much liquid withdrawn that a portion of the liquid nozzle or of the liquid line leading to the liquid nozzle is empty. The liquid is withdrawn only to the point that no droplet is any longer hanging down, yet the rim of the liquid nozzle is still in contact with the liquid. It is in particular provided that the liquid is withdrawn to the point that a liquid meniscus of concavely shaped cross section forms in the liquid nozzle.

In this way, on the one hand, dripping is substantially prevented. On the other hand, through the withdrawal of liquid, no greater gas flow is generated by suction, which greater gas flow could result in oxygen passing into the region of the opening of the liquid nozzle.

Furthermore, in one embodiment of the invention, the liquid nozzle is blown against from below with a protective gas, in particular nitrogen. It is in particular provided that, via at least one duct, from which the protective gas exits, nitrogen is passed obliquely beneath the opening of the liquid nozzle, so that the protective gas flow is directed counter to the running direction of the exiting liquid. In this way, the withdrawal of the liquid is promoted and the risk of dripping is further reduced.

In addition, also lying within the scope of the invention is a method for filling medical packaging, wherein the packaging is filled with a liquid via an entrance and the entrance, during the filling process, is provided in a protective atmosphere. The method is characterized in that the packaging, prior to being filled with the liquid, is filled with an inert gas. The inert gas then provides the headspace of the filled and sealed packaging. Possible embodiments of the method can be gleaned from the previously described embodiments of the method.

The invention further relates to a device for filling a medical packaging configured as a pouch. The device is in particular configured for the use of the method previously described.

The device comprises a filling head having a gas nozzle for feeding an inert gas into the packaging and having a liquid nozzle for the filling of the packaging. An opening for the provision of a protective atmosphere extends, at least in some sections, around the liquid nozzle and/or the gas nozzle.

The filling head is preferably configured in one piece. The gas nozzle and the liquid nozzle are preferably spaced at a distance apart.

According to one embodiment of the invention, extending around the liquid nozzle and/or the nitrogen nozzle are a plurality of openings, from which a protective gas, preferably nitrogen, exits in order to provide the protective atmosphere. In particular, the openings extend, at least in some sections, in a circle around the gas nozzle and/or the liquid nozzle.

Via the openings, in the region of the gas nozzle and/or the liquid nozzle a preferably substantially laminar protective gas flow is attained, so that the discharge opening of the gas nozzle and/or of the liquid nozzle is located fully in a protective atmosphere.

In a preferred embodiment of the invention, the gas nozzle and/or the liquid nozzle are located in a depression, wherein the gas nozzle and/or the liquid nozzle has or have an opening distanced from a rim of the depression.

By the depression is formed a bell, within which the liquid nozzle and/or the gas nozzle are arranged. The bell formed by the depression is preferably purged with the protective gas, preferably nitrogen, throughout the filling operation, by the continuous generation of a laminar protective gas flow, preferably nitrogen flow, via the openings.

Preferably, the filling head additionally comprises a further duct, from which a protective gas, preferably nitrogen, exits, and via which an outlet opening of the liquid nozzle is blown against with the protective gas.

The invention further relates to the use of the above-described device for filling a medical packaging configured as a pouch.

The invention further relates to a pharmaceutical product comprising a medical packaging which is configured as a pouch and which in particular is producible or produced with the previously described method, and/or in particular using the previously described device.

The medical packaging configured as a pouch is filled with a liquid, in particular with a liquid containing an active agent or with a solution for parenteral feeding. Preferably, the liquid is a medical liquid which is to be administered intravenously.

In a preferred embodiment, the liquid is a medical liquid which is oxygen-sensitive, preferably to a high degree, and is to be administered intravenously.

In particular, the active agent is at least one active agent which is selected from a group consisting of paracetamol, cyanocobalamin, dexamethasone, etoposides, gentamicin, tobramycin and granisetron. The active agent can be present dissolved and/or dispersed in the liquid.

The inner volume of the medical packaging or of the pouch has a gas volume. According to the invention, the oxygen content in the gas volume of the packaging, at least directly after the filling, amounts to less than 1% by volume, preferably less than 0.5% by volume.

The gas volume present in the pouch amounts to 10 to 50 ml, preferably from 15 to 30 ml. The volume can be easily determined by a removal of gas from the filled and sealed pouch with a needle syringe.

The invention has thus succeeded in providing medical packagings having a gas volume which, already directly after the filling, has an oxygen content of less than 1% by volume. Moreover, the invention is distinguished by a relatively low nitrogen consumption. For the filling operation with nitrogen atmosphere, under 20 liters per minute, preferably under 10 liters per minute, for example around 8 liters per minute, of nitrogen per filling point are consumed. As a result, for example no further protective measures against oxygen deficiency for the operating staff of the filling plant are necessary.

In a further embodiment, the packaging is arranged in a secondary packaging comprising an oxygen barrier, preferably a metal foil. The secondary packaging has at least one metal layer, which acts as an oxygen barrier. This can here be in the form of, for example, an aluminum foil.

In one embodiment, the secondary packaging is provided by a deep-drawn foil, preferably an aluminum foil, into which the packaging is inserted and which is sealed by a, preferably transparent, foil, which has an oxygen barrier. The oxygen barrier in the cover foil can be provided, for example, by a silicon oxide and/or aluminum oxide layer.

Moreover, the secondary packaging can also be evacuated and/or filled with a protective gas, for example nitrogen.

Preferably, in the secondary packaging is found only the medical packaging configured as a pouch, thus the primary pouch. An oxygen absorber, such as, for instance, inserted iron filings, is found in the packaging, though preferably not.

BRIEF DESCRIPTION OF THE DRAWINGS

The subject of the invention shall be explained in greater detail below, with reference to an illustrative embodiment on the basis of the drawings FIG. 1 to FIG. 9.

DETAILED DESCRIPTION OF THE DRAWINGS

Figure 1:
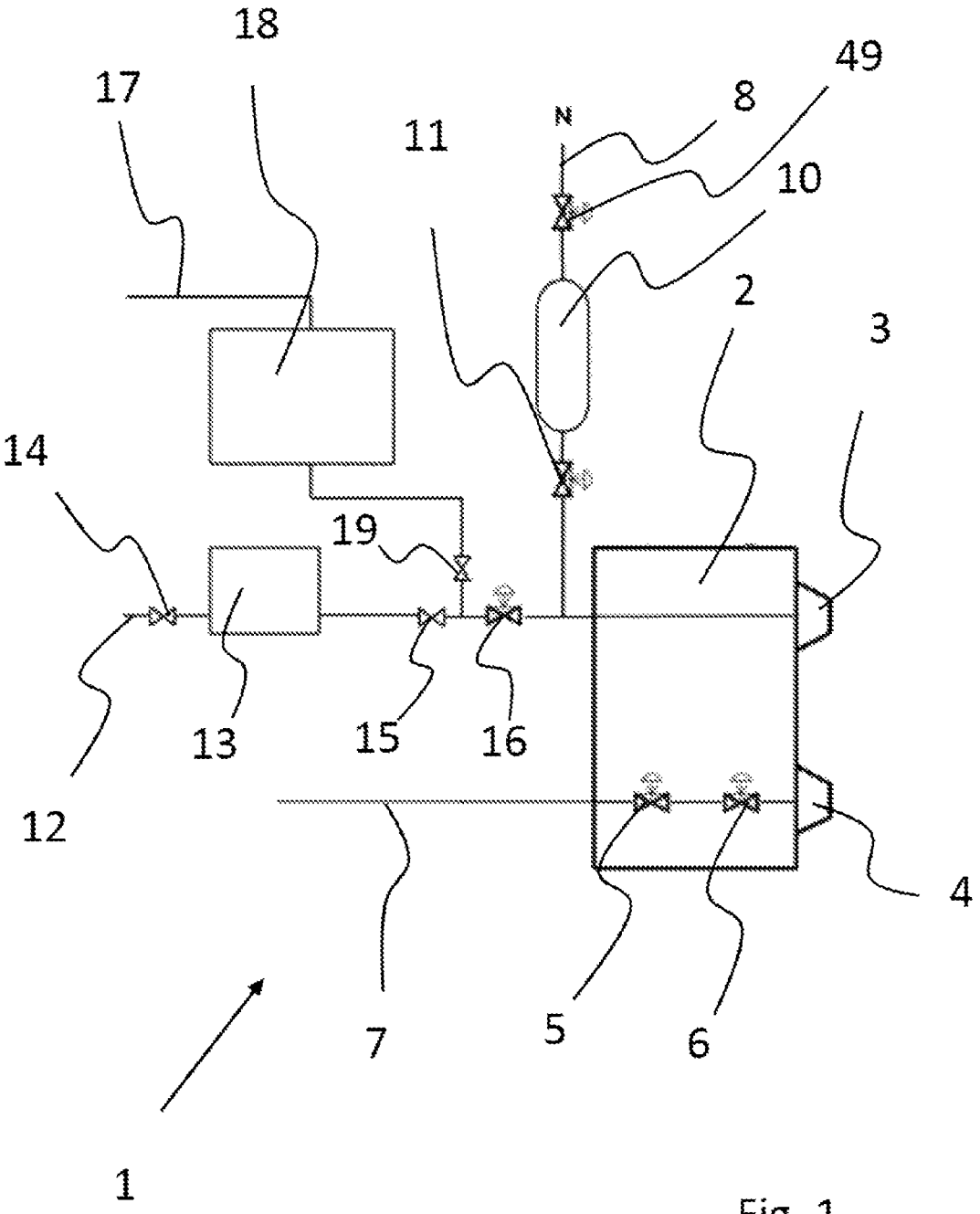
FIG. 1 is a schematic representation of a plant for filling a medical packaging configured as a pouch.

FIG. 1 shows in a basic diagram the component parts of a device 1 for filling a medical packaging 20 configured as a pouch.

The device 1 comprises a filling head 2, which in this illustrative embodiment is configured as a block and which comprises a gas nozzle 3 and a liquid nozzle 4. The gas nozzle 3 provides the inert gas for prefilling of the pouch. In the presently described illustrative embodiment, nitrogen is used as the inert gas. For this reason, the gas nozzle 3 is in short referred to in the following description as the nitrogen nozzle 3. The liquid nozzle 4 and the nitrogen nozzle 3 are arranged side by side and at a distance apart.

In the presently described illustrative embodiment, the entrance 20 to the pouch is provided by the filler opening 51 of the port 22.

The nitrogen nozzle 3 to which the medical packaging 20 is docked with a filler opening 51 of the port 22 serves both to fill with nitrogen the medical packaging 20 configured as a pouch and to evacuate the packaging 20.

For the evacuation, the nitrogen nozzle 3 is connected to a vacuum line 17. Via the valve 19 and the valve 16 configured as a switching valve, a docked pouch 20 is evacuated. A filler opening 51 of the pouch 20 (see FIG. 6) is here docked sealingly to the nitrogen nozzle 3, for example pressed onto it. The nitrogen nozzle 3 can consist, for example, of an elastic material. Alternatively or additionally, the nitrogen nozzle 3 can comprise a seal.

The vacuum used for the evacuation (prior to the filling) is hereinafter also referred to as a "deep vacuum". This is a vacuum in which preferably a pressure of less than 100 mbar is applied at the filler opening 51.

In the vacuum line 17 is found a container 18, which serves as a buffer volume. By the buffer volume, the fall in pressure which occurs at the nitrogen nozzle 3 upon opening of the valves 16 and 19 is reduced.

In this illustrative embodiment, the nitrogen nozzle 3 is connected to a further vacuum line 12. Via the switching valve 16 and the valves 14 and 15, vacuum can also be applied at the nitrogen nozzle 3 via the vacuum line 12. In this illustrative embodiment is arranged in the vacuum line 12 a container 13, which is provided with a pressure sensor (not represented) which measures the pressure inside the container 13.

Following docking of a pouch 20 to the nitrogen nozzle 3, in a first step the container 13 is evacuated via the valve 14, while the valve 15 is still closed. The valve 14 is next closed. After this, the valves 15 and 16 are opened. By contrast, the valve 19 is or remains closed. In the event of a leak, in the container 13 a rise in pressure greater than a predefined reference value shall be detected and the filling operation is not started. In this integrity test, the pressure does not need to be as low as in the evacuation of the pouch 20 before it is filled in a following step.

If the pouch 20 has passed the leak test, the valve 15 is closed and the valve 19 opened. Via the vacuum line 17, a higher negative pressure then obtains at the nitrogen nozzle. The pouch 20 docked to the nitrogen nozzle 3 is now in the evacuated state.

Next, the pouch 20 is filled with nitrogen as the inert gas. For this, at least the valve 16 is closed. A defined volume of nitrogen is passed via the nitrogen nozzle 3 into the pouch 20. To this end, the nitrogen nozzle 3 is connected to a supply line 8 for the inert gas, here nitrogen. In order to introduce a defined quantity of nitrogen, the supply line 8 leads via a container 10. In front of and behind the container 10 is respectively found a valve 11, 49 configured as a switching valve.

For the introduction of a defined volume of nitrogen, the valve 49 is firstly opened, while the valve 11 is still closed. The container 10 is now filled with nitrogen, wherein the pressure arising in the container 10 corresponds to the pressure applied via the supply line 8.

Next the valve 49 is closed and, after this, the valve 11 is opened. The nitrogen enclosed in the container 10 can now expand and, via the nozzle 3, nitrogen escapes into a docked pouch 20 until such time as a pressure equalization has taken place.

By way of the volume of the container 10 and the pressure in the container 10, as well as the pressure in the supply line 8, the volume of nitrogen that flows into the pouch 20 is determined. In the container 10, a pressure of 0.5 bar to 4.0 bar for the nitrogen supply for the gassing is provided. The container 10 is here dimensioned such that and/or the pressure in the container 10 is chosen such that the nitrogen volume which flows into the pouch 20, inclusive of the volume of the port 22, corresponds to the desired remaining gas volume of the pouch 20 after this has been filled with liquid.

Once the pouch 20 is filled with nitrogen, it is temporarily sealed and transferred to the liquid nozzle 4 and filled there with liquid. In the temporary sealing, the entrance 22 to the pouch 20, here the filler opening 51 of the port 22, is shut off, preferably clamped shut (see the following FIGS. 5 to 5*b* and 9).

The liquid nozzle 4 is connected via the supply line 7 to a reservoir (not represented), via which a medical packaging 20 docked to the liquid nozzle 4 is filled with liquid. The medical packaging 20 is here docked with a filler opening 51 to the liquid nozzle 4. During the docking, a leak-tight connection exists between the liquid nozzle 4 and the filler opening 51. For this, the liquid nozzle 4 is applied by pressing sealingly to the filler opening. The liquid nozzle can have a seal or consist of a sealing elastic material.

In order to control the filling operation, the filling device 1 comprises at least one valve 5, 6. In this illustrative embodiment, two valves 5, 6 configured as switching valves are arranged one behind the other. A valve 6 serves for fine dosing and is configured such that it can alter the volume in the inflow, whereby a small quantity of liquid can be withdrawn. As a result, after the medical packaging 20 has been undocked from the liquid nozzle 4, a droplet formation and dripping is prevented.

After the filling, the pouch 20 is again temporarily sealed (see also FIGS. 5 to 5*b* and 9) and moved to a sealing device (not represented here), here in the form of a seal receptacle 29. The port 22 is sealed at the seal receptacle 29 with a seal 23 configured, in particular, as a cap.

The filling and sealing operation is hence at an end and the pouch 20 can be ejected and transported onward. Further details relating to the method according to the invention are described in particular in FIG. 9.

Figure 2:
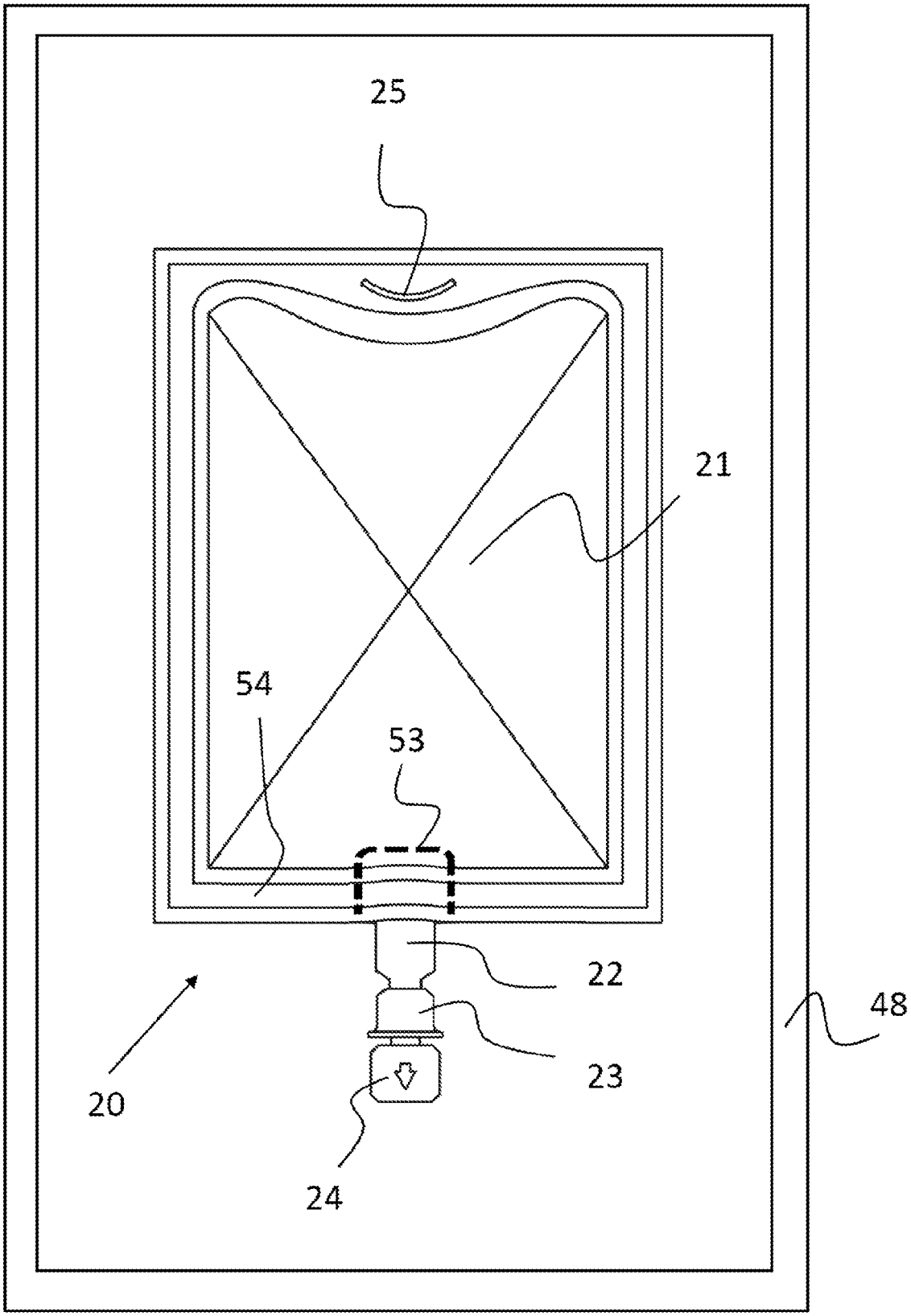
FIG. 2 shows a medical packaging, configured as a pouch, which is inserted into a secondary packaging.

FIG. 2 shows a medical packaging 20 configured as a pouch 20. The pouch 20 consists of a welded-together foil, in particular a polyolefin foil. The pouch 20 comprises an inner volume 21, which is preferably between 50 and 1000 ml, particularly preferredly between 80 and 150 ml, in size.

The pouch 20 comprises a hanger 25 and a port 22, which is welded in the transverse weld 54 and is sealed with a snapped-on seal 23, which in this embodiment has a break-off cap 24.

The pouch 20 is inserted into a secondary pouch 48, which serves as a secondary packaging. The pouch in its secondary pouch is subsequently, preferably thermally, sterilized. The secondary pouch 48 can be torn open, for example, in order to remove the pouch 20. The secondary pouch 48 preferably consists of a foil having an oxygen barrier layer, in particular a metal foil. The secondary pouch 48 can possess a nitrogen-filled inner volume.

Figure 5:
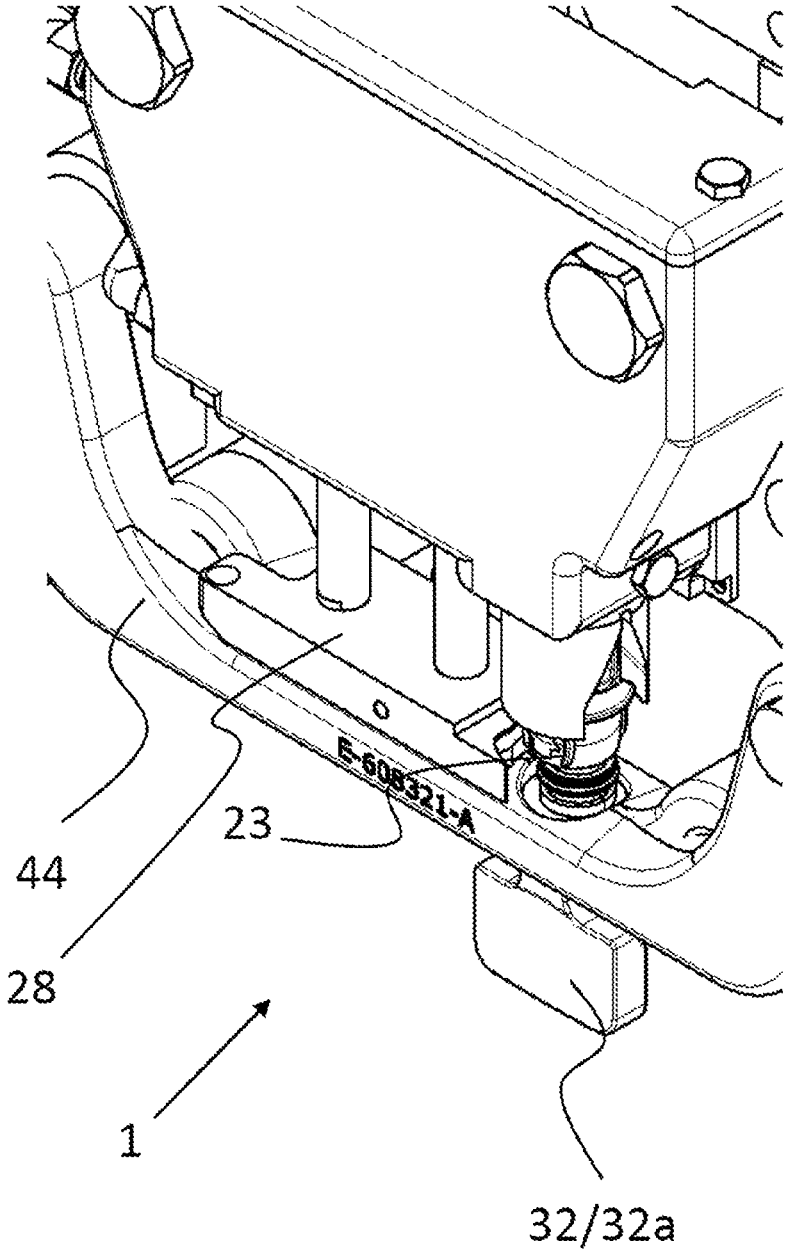
FIG. 5 is a perspective view of the filling device, in which the squeezing pincer for sealing the port is represented.
Figure 5A:
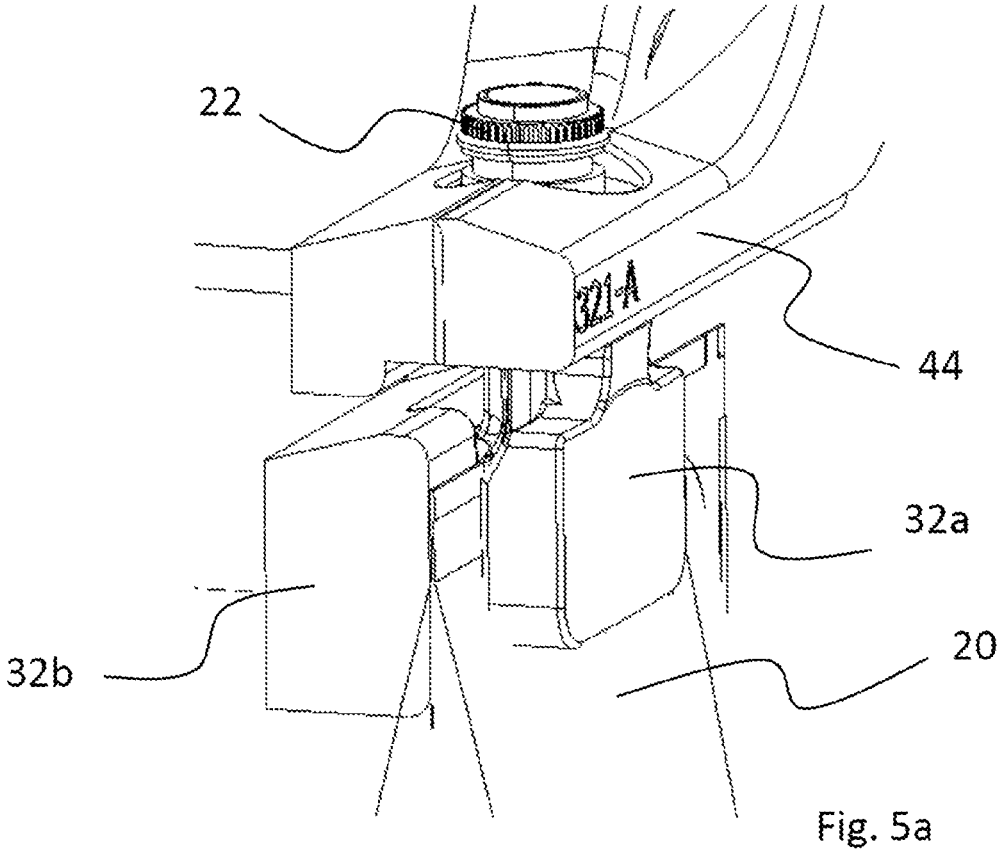
FIG. 5*a* and FIG. 5*b* are perspective detailed views of the filling device, in which the opposing jaws of the squeezing pincer are represented in the closed state with pouch (FIG. 5*a*) and in the open state without pouch (FIG. 5*b*).
Figure 5B:
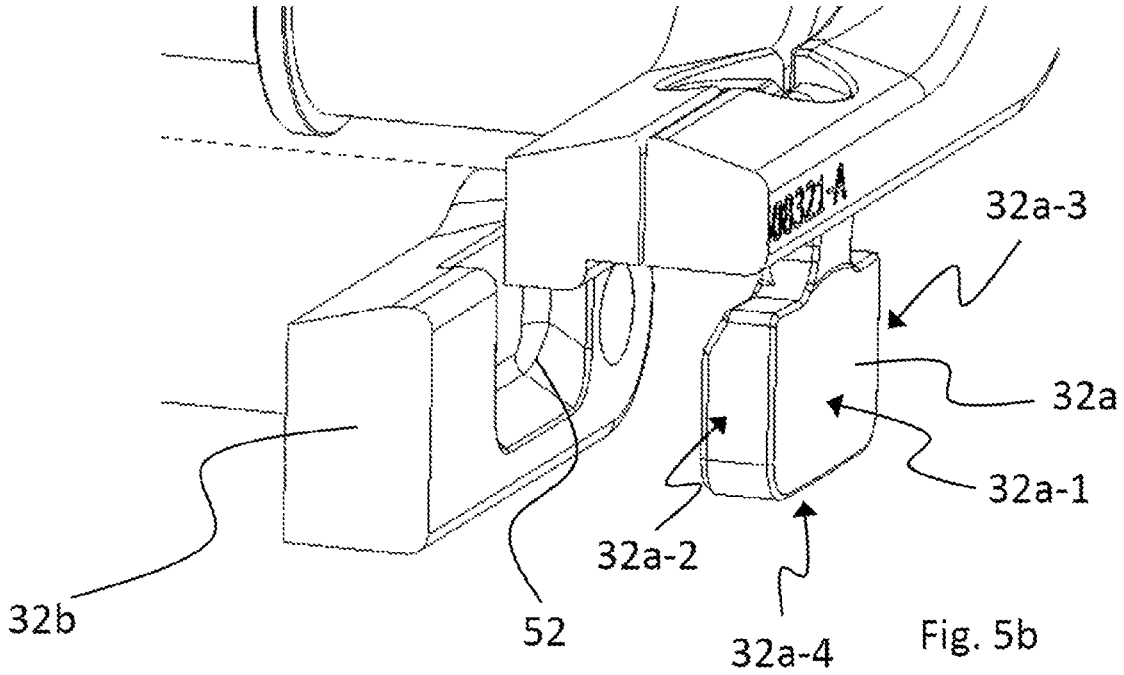

Furthermore, the position 53 of the bearing surface of a jaw 32*a*, 32*b* of a squeezing pincer 32 is illustrated with a dashed line (cf. also FIGS. 5*a* and 5*b*).

Figure 3:
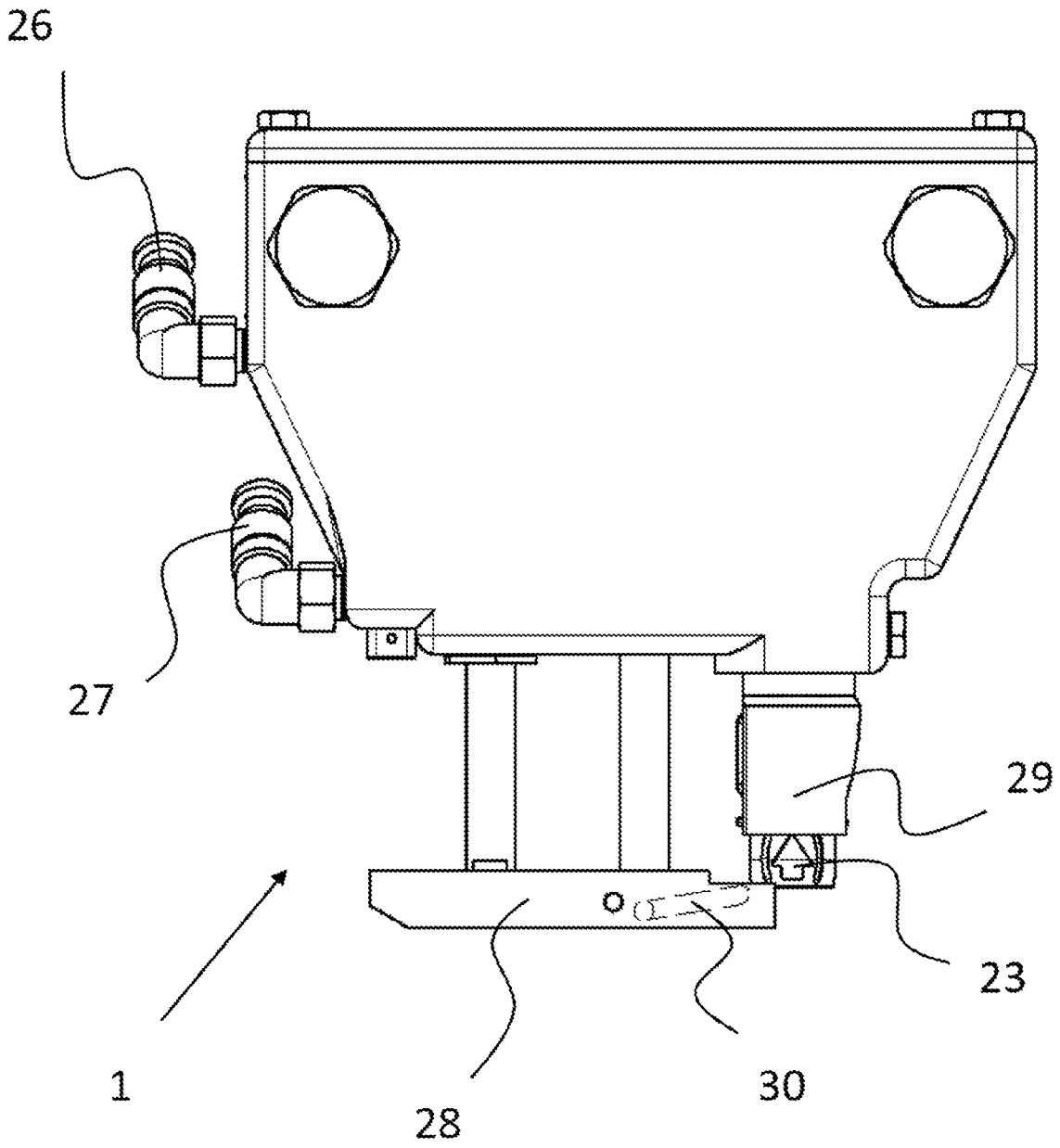
FIG. 3 shows in a side view parts of the filling plant, wherein in this view the seal receptacle for mounting of the seal is represented.

FIG. 3 shows in a side view parts of the device 1 for filling a pouch 20. In this view, the sealing device is represented in the form of the seal receptacle 29. In this illustrative embodiment, this can receive, by way of pneumatic suction, a seal 23, which is snapped onto the port 22 of a pouch 20.

Represented is a nitrogen connection 26, for the gassing of the seal 23 with nitrogen, and a pneumatic connection 27, via which compressed air is provided to operate the moving parts of the device 1. Further connections, in particular the connection for supplying liquid for the filling of the pouch 20, cannot be seen in this view.

The device comprises a movable support 28, in which is found a duct 30, via which the seal 23 and the port 22 of the pouch 20 are gassed with nitrogen.

The duct 30 is directed obliquely upward, so that the exiting nitrogen flow purges with nitrogen the seal 23 held by the seal receptacle 29.

Figure 4:
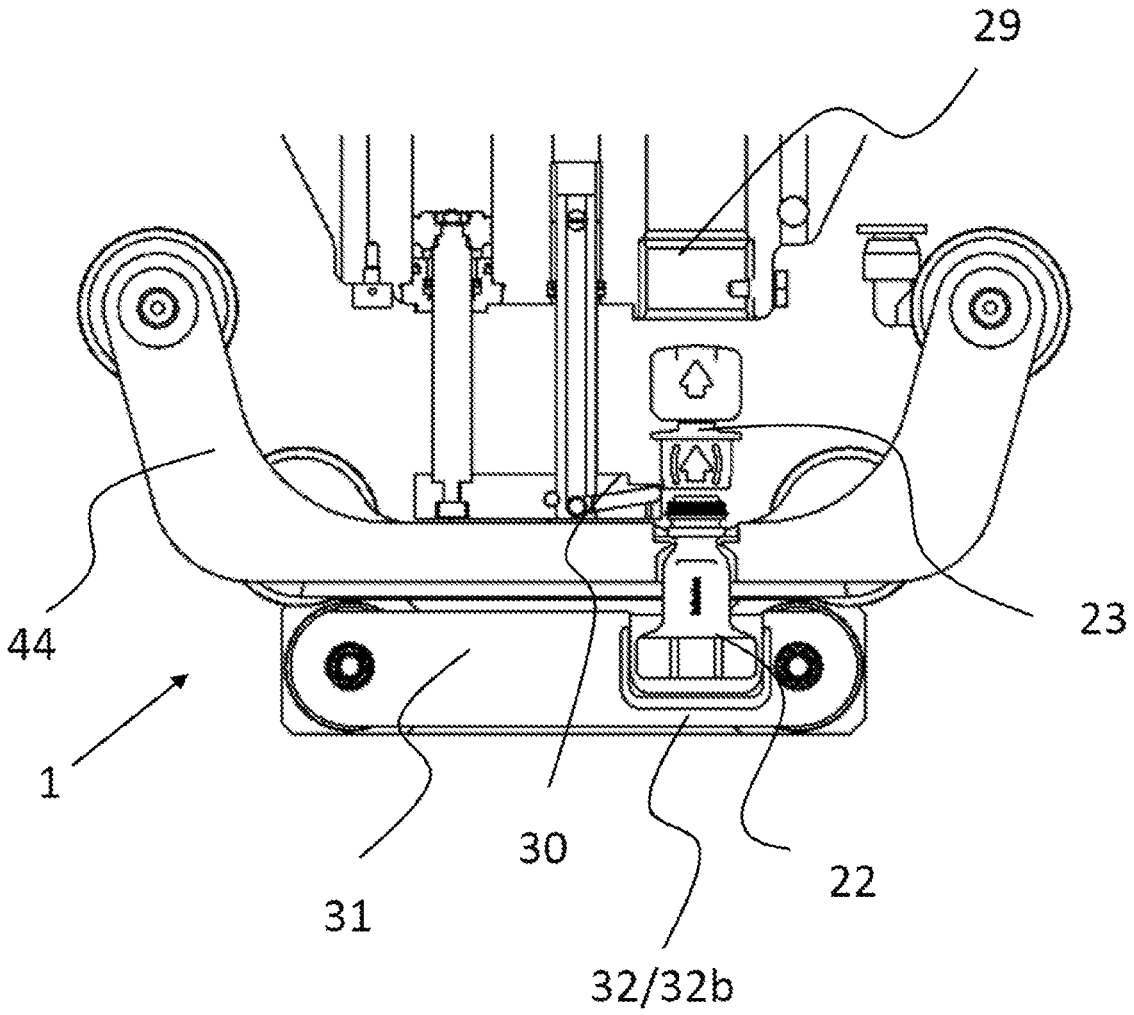
FIG. 4 is a further view of the filling device, wherein in this view the components arranged around the seal and the port are blanked out.

The support 28 for the duct 30 can be moved upward in order to be able to get out of the way when a pouch 20 to be filled is supplied, in particular in order to be able to evade a support 44 holding the pouch 20 (see FIG. 4 and FIG. 5).

Behind the seal receptacle 29 in the image plane is found a filling head 2 (not visible in this representation) for filling the pouch 20 with liquid and for filling it with nitrogen.

FIG. 4 is a further view of the plant 1 for filling medical packagings 20 configured as pouches 20. In this view is represented the support 44, which serves as a gripping element for the pouch 20 and feeds this to the nitrogen nozzle 3, the liquid nozzle 4 and the seal receptacle 29.

For this, the pouch 20 is grasped at the port 22 and moved from the support 44 to the nitrogen nozzle 3 and to the liquid nozzle 4, as well as to the seal receptacle 29. Via the duct 30, the seal 23 is gassed in the region of the filler opening 51 of the port 22.

Further represented is a support 31, on which a law 32*b* of the squeezing pincer 32 is movably arranged (see FIG. 5, as well as FIGS. 5*a* and 5*b*).

In this illustrative embodiment of the invention, the squeezing pincer 32 can be opened and closed via the support 31 in order to clamp shut the pouch 20 around the port 22. Otherwise, the support 31 is moved together with the support 44.

FIG. 5 is a perspective view of the plant 1. Represented is, in particular, the support 44, via which the pouch 20 is gripped and moved.

Furthermore, in this representation can be seen one half 32*a* of the squeezing pincer 32. The squeezing pincer 32 is configured such that the foil material of the pouch 20 can be compressed around the welded-in port 22, and hence the pouch 20 can be clamped shut. The pouch 20 is thus shut off, or temporarily sealed, by closing of the squeezing pincer 32 around the port 22. With the squeezing pincer 32, the pouch 20 is shut off or clamped shut when this, for the execution of the various method steps, is shifted during the filling process.

As previously described, the support 28 for the duct 30 for gassing the seal 23 with nitrogen can be moved vertically in order to evade the support 44. By a lowering of the support 28, nitrogen can be blown into the seal 23 via the duct 30.

FIG. 5*a* and FIG. 5*b* show perspective cutaway detailed views of the filling device 1, in which the region of the squeezing pincer 32 is represented.

FIG. 5*a* shows how the closed squeezing pincer 32 clamps shut a pouch 20. The squeezing pincer 32 comprises the opposing jaws 32*a* and 32*b*. The jaw 32*b* is arranged on the support 44, with which the pouch 20 is grasped and moved. By the jaw 32*a* which is movable in relation to the jaw 32*b*, the squeezing pincer can be closed and the pouch 20 shut off, here clamped shut.

FIG. 5*b* is a perspective cutaway view of the opened squeezing pincer 32 (without pouch 20). The jaw 32*b* comprises an upwardly open recess 52, in which, when the squeezing pincer is closed, is found a welded portion of a port 22, in particular a welding shuttle 34. The recess 52 is of substantially U-shaped configuration.

The opposing jaw 32*a* is a type of open hollow body or case. The jaw 32*a* is formed by the base plate 32*a*-1, the two lateral side walls 32*a*-2 and 32*a*-3, and the lower side wall 32*a*-4 (the two side walls 32*a*-3 and 32*a*-4 are not visible in the shown perspective). Upward in the direction of the port 22 and laterally in the direction of the welding jaw 32*b*, the welding jaw 32*a* is of open design. The welding jaw 32*a* is of substantially U-shaped configuration. The U-shape or the U-shaped portion of the welding jaw 32*a* is formed by the side walls 32*a*-2, 32*a*-3, 32*a*-4 of the jaw 32*a*. The U-shaped portion formed by the jaw 32*a*, when the squeezing pincer is closed, comes to bear around the recess 52 of the opposing jaw 32*b*. In detail, the end faces of the side walls 32*a*-2, 32*a*-3, 32*a*-4 of the jaw 32*a* come to bear around the recess 52 of the opposing jaw 32*b*.

The foils of the pouch 20 are in this way compressed around the welded region of the port 22, so that the pouch 20 is clamped shut and no fluid can escape or enter.

The position 53 of the bearing surface of the law 32*a* on the pouch is represented in FIG. 2. The end faces of the side walls 32*a*-2, 32*a*-3, 32*a*-4 of the jaw 32*a* come to bear at the position 53. The bearing surface 53 is also of U-shaped configuration, wherein the base is arranged beneath the welding shuttle 34 of the port 22. The side members of the bearing surface 53 extend laterally along the welding shuttle 34 and reach at least up to the height of a transverse weld 54 of the pouch 20. In this way, the pouch 22 can be clamped shut with the squeezing pincer 32 around the welded portion of the port 22.

Due to the U-shaped design of the squeezing pincer 32, the port 22 itself is not clamped shut, however, since the welded region of the port 22, when the squeezing pincer is closed, is found in part in the recess 52 and in part between the side members of the U-shaped portion of the jaw 32*a*.

Figure 6:
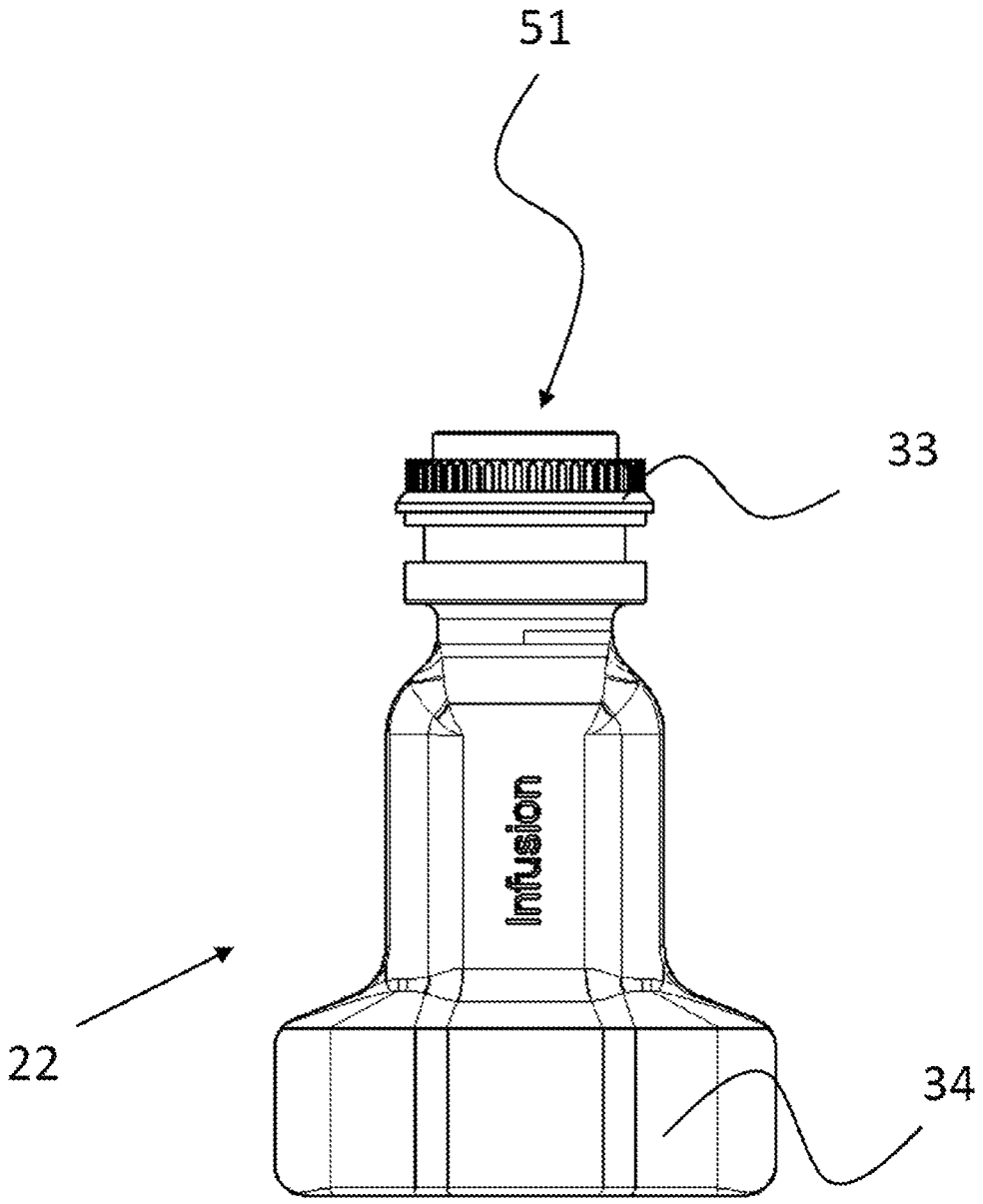
FIG. 6 is a detailed view of a port without mounted seal.

FIG. 6 is a detailed view of the port 22 in one possible embodiment. The port 22 comprises a tapered welding shuttle 34, which serves as a welded portion, and a filler opening 51, beneath which is found a collar 33. The seal 23 can be snapped onto the collar 33.

The pouch 20 is filled with liquid via the filler opening 51. Once the seal is fitted, the filler opening 51 serves at the same time for the formation of a port 22 provided with a septum.

The filler opening 51 of the port 22 can be docked sealingly both to the nitrogen nozzle 3 and to the liquid nozzle 4.

Figure 7:
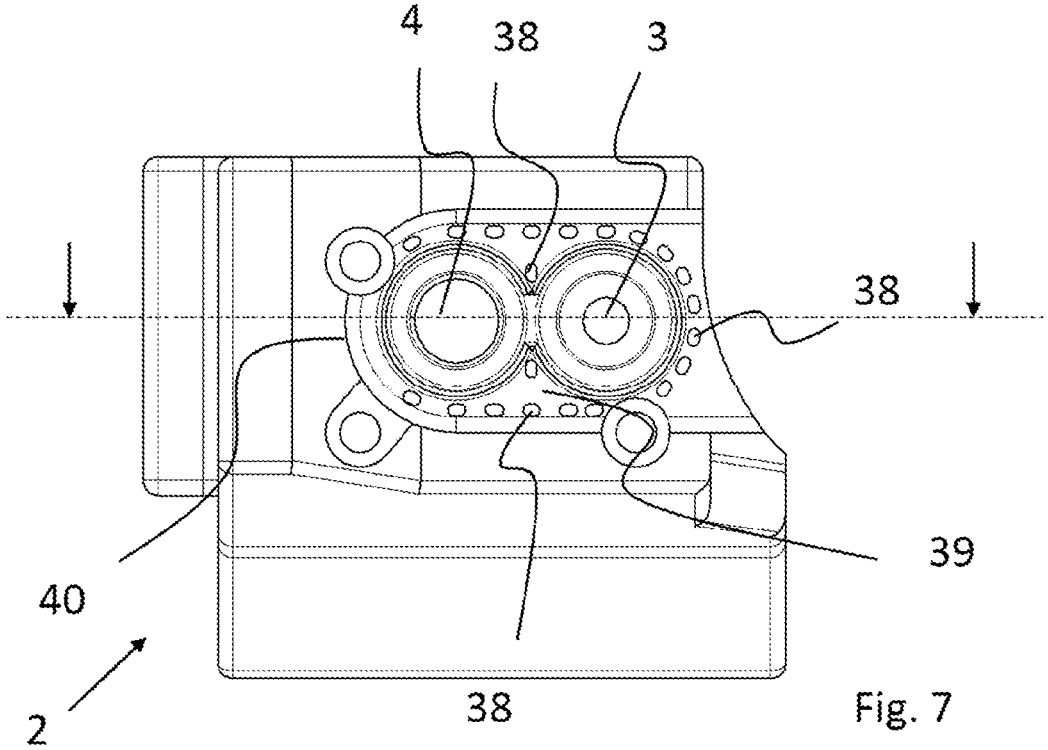
FIG. 7 is a top view of the underside of the filling head, in which the liquid nozzle and the nitrogen nozzle are represented.
Figure 8:
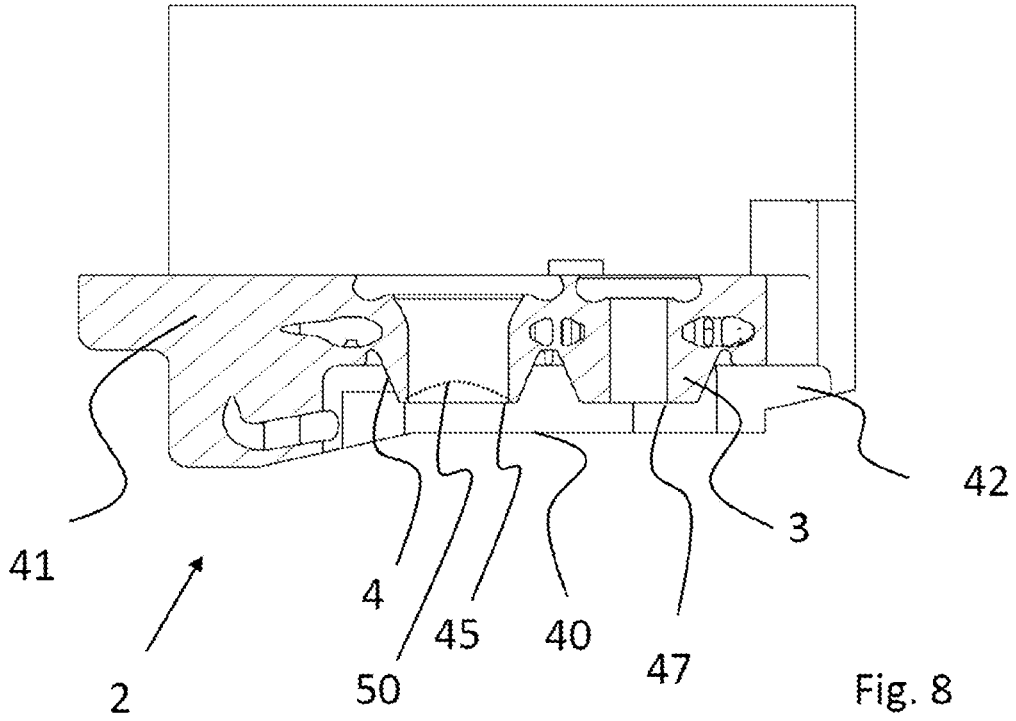
FIG. 8 shows a sectional view of the filling head.

FIG. 7 and FIG. 8 show different views of the filling head 2. In the installed state, the filling head 2 is seated behind the seal receptacle 29 represented in FIG. 3. The filling head 2 comprises a connecting piece for fastening to the plant 1.

The filling head 2 further comprises a product connection and a gas connection.

Via the product connection, which is connected to the liquid nozzle 4, liquid is supplied for the filling of the pouch 20.

Via the gas connection, which is connected to the nitrogen nozzle 3, the pouch 20 can both be evacuated and filled with nitrogen.

In this embodiment of the invention, the valve 6 designed as a switching valve is integrated into the filling head 2. Via the switching valve 6, a fine dosing can be conducted. At the same time, via the valve 6, a volume change can be produced in the liquid inflow, whereby a liquid droplet can be withdrawn.

FIG. 7 is a top view of the underside of the filling head 2. The filling head 2 comprises a nitrogen nozzle 3 and a liquid nozzle 4. The liquid nozzle 4 has a greater diameter than the nitrogen nozzle 3. Preferably, the diameter of the liquid nozzle 4 lies between 4.5 and 6.5 mm. The diameter of the nitrogen nozzle 3 is preferably between 2.5 and 3.5 mm.

In the installed state, the nitrogen nozzle 3 is seated behind the seal receptacle 29 represented in FIG. 3. There then follows the liquid nozzle 4. The nitrogen nozzle 3 is arranged between the liquid nozzle 4 and the seal receptacle 29.

Extending annularly around the nitrogen nozzle 3 and the liquid nozzle 4 are openings 38, from which nitrogen exits and with which a laminar flow is generated in the direction of the flow direction of the product, thus of the liquid stream, during the filling process. The openings 38 are located in a depression 39, the rim 40 of which extends along the underside of the filling head 2.

Laterally adjacent to the nitrogen nozzle 3, the depression 39 is open toward the side and, in the fitted state, directly adjoins the seal receptacle 29. There is thus formed bv the depression 39 a duct 42, which reaches as far as the seal receptacle 29 and which, during the operation of the filling device 1, is continuously purged with nitrogen in order to provide a protective atmosphere.

FIG. 8 is a sectional view along the sectional line marked in FIG. 7. The lower end of the filling head 2 is configured as an insert 41 made of high-quality steel, which insert is connected, in particular bonded and/or bolted, to the rest of the filling head 2, and, where appropriate, sealed off with sealing rings. This insert 41 comprises the liquid nozzle 4 and the nitrogen nozzle 3, to which the filler opening 51 of the port 22 can be docked.

The rim 45 of the liquid nozzle 4, and also the rim 47 of the nitrogen nozzle 3, are distanced from the rim 40 of the depression 39. Hence the discharge openings of liquid nozzle 4 and nitrogen nozzle 3 are located within a duct 42 which is open at the bottom and which, in the operating state, is purged with nitrogen by a preferably laminar nitrogen flow.

In addition, in this detailed representation is indicated a meniscus 50, which the liquid forms when the pouch 20 is undocked from the liquid nozzle 4.

As the pouch 20 is undocked, liquid is withdrawn to the inflow duct by way of a volume enlargement of the valve 6, so that the liquid forms a concave meniscus 50. The liquid here reaches up to the rim 45 of the liquid nozzle 4.

Via the duct 46, the liquid and the filler opening of the liquid nozzle 4 are blown against obliquely from below, in particular at an angle of 10-60° to the horizontal plane. This inhibits the formation of droplets and promotes the formation of the concave meniscus 50. At the same time, the liquid is not withdrawn in such a way that gas is sucked in and hence, because of flow, oxygen might also be drawn into the region of the liquid nozzle 4.

Figure 9:
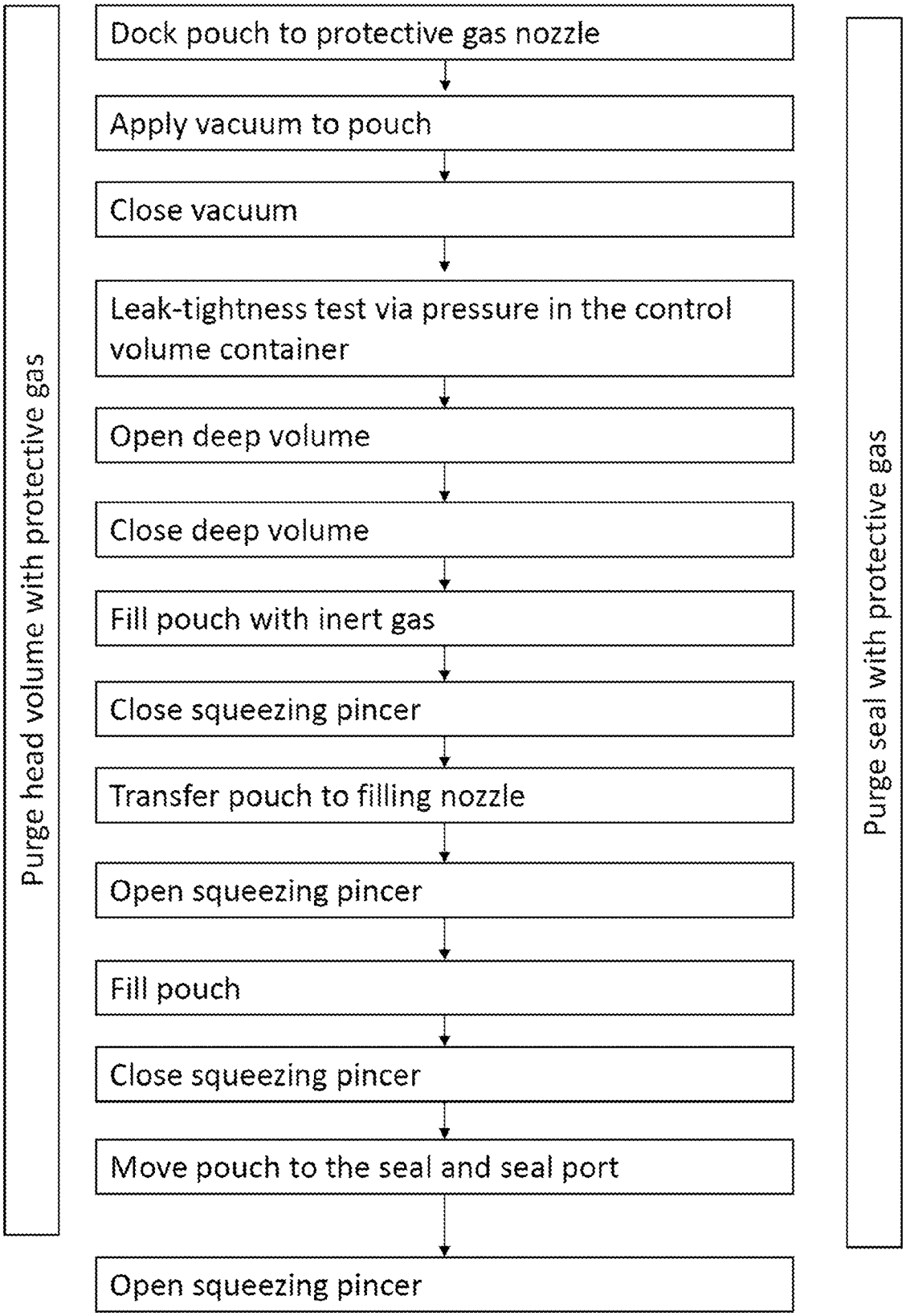
FIG. 9 shows in a flow chart the method steps of an illustrative embodiment of the invention.

FIG. 9 shows in a flow chart the method steps according to an illustrative embodiment of the invention.

Firstly, the pouch 20 is received bv means of the support 44 of the filling device 1 and docked to the nitrogen nozzle 3 with the filler opening 51 of the port 22.

Next, via the line 12, vacuum is applied in the container 13. Then the valve 14 is closed. By opening of the valves 15 and 16, the vacuum is also applied in the pouch 20. Via a pressure sensor in the container 13, it is checked whether the pouch 20 is leak-tight by comparing the resulting pressure drop with a predefined reference range.

If the pouch 20 is leak-tight, a deep vacuum is next applied via the vacuum line 17 and through opening of the valve 19.

Following the application of the deep vacuum, the valve 19 is closed.

In the next step, the pouch 20 is filled with the inert gas, here nitrogen, in that, by actuation of the valves 11 and 49, a defined volume of nitrogen is fed into the pouch 20 via the container 10. The fed-in volume substantially corresponds to the desired gas volume of the pouch 20.

Subsequent to the filling, the pouch 20 is shut off, here clamped shut, by closing of the squeezing pincer 32.

The pouch 20, now filled with inert gas, is next transferred from the nitrogen nozzle 3 to the filling nozzle, thus to the liquid nozzle 4. As a result of the sealing with the squeezing pincer 32, as is prevented during the transfer from entering or exiting the pouch 20.

Next, the squeezing pincer 32 is opened and the pouch 20 is filled via the liquid nozzle 4.

At the end of the filling operation, the liquid in the liquid nozzle 4 is reset via the valve 6, so that, from the liquid nozzle 4, nothing drips when the pouch 20 is subsequently moved to the seal 23, where the port 22 is sealed with the seal 23.

When moved from the liquid nozzle 4 to the seal receptacle 29, the pouch 20, now filled with liquid and inert gas, is likewise shut off, here with the squeezing pincer 32.

Once the pouch 20 is sealed with the seal 23, the squeezing pincer 32 is opened and the pouch 20, now ready filled and sealed by the seal 23, can be elected and transported away.

Throughout the filling operation, the head volume, thus the region comprising the liquid nozzle 4, the nitrogen nozzle 3 and the filler opening 51 of the port 22, is continuously purged with nitrogen. The components are constantly in a protective atmosphere.

The seal 23 too is purged with nitrogen, wherein a support 28, which comprises the duct 30 provided for this purpose, is moved upward as the pouch 20 is supplied, in order to be able to get out of the way.

The invention has succeeded in reducing the residual oxygen content in the remaining gas volume of a pouch 20 to below 1% by volume.

REFERENCE SYMBOL LIST

1 device for filling a pouch
2 filling head
3 gas nozzle or nitrogen nozzle
4 liquid nozzle
5 valve
6 valve
7 supply line
8 supply line
9 valve
10 container
11 valve
12 vacuum line
13 container
14 valve
15 valve
16 valve
17 vacuum line
18 container
19 valve
20 medical packaging/pouch
21 inner volume
22 entrance or port
23 seal
24 break-off cap
25 hanger
26 nitrogen connection
27 pneumatic connection
28 support
29 sealing device or seal receptacle
30 duct
31 support
32 squeezing pincer
32*a*, 32*b* jaws of the squeezing pincer
32*a*-1 base plate or base surface of the jaw 32*a*
32*a*-2 lateral side wall of the jaw 32*a*
32*a*-3 lateral side wall of the jaw 32*a*
32*a*-4 lower side wall of the jaw 32*a*
33 collar
34 welding shuttle
38 opening
39 depression
40 rim
41 insert
42 duct
43 duct
44 support
45 rim
46 duct
47 rim
48 secondary packaging/secondary pouch
49 valve
50 meniscus
51 filler opening
52 recess
53 position of the bearing surface of a jaw of the squeezing pincer
54 transverse weld

The invention claimed is:

1. A method for filling a medical packaging, wherein the packaging is filled with a liquid via an entrance and the entrance, during the filling process, is provided in a protective atmosphere, wherein the packaging, prior to being filled with the liquid, is filled with an inert gas by means of a gas nozzle, wherein, for the provision of the protective atmosphere, at least one opening extends, at least in some sections, around the gas nozzle.

2. The method as claimed in claim 1, wherein the packaging is filled with a volume of the inert gas which corresponds to at least the volume of a gas volume remaining after the filling of the packaging.

3. The method as claimed in claim 2, wherein the packaging is filled with a volume of the inert gas which corresponds to at least the volume of a gas volume remaining after the filling of the packaging with a volume of the inert gas of 15 to 30 ml.

4. The method as claimed in claim 1, wherein the packaging, prior to being filled with the inert gas, is evacuated.

5. The method as claimed in claim 4, wherein the packaging, prior to being filled with the inert gas, is evacuated, by application of a pressure of below 100 mbar.

6. The method as claimed in claim 1, wherein the packaging is filled with the liquid using a filling head, wherein the filling head has a gas nozzle and a liquid nozzle, and the packaging, after having been filled with the inert gas, is transferred from the gas nozzle to the liquid nozzle.

7. The method as claimed in claim 1, wherein the entrance, upon transfer of the packaging from the gas to the liquid nozzle, is shut off and/or in that the packaging, after having been filled with the liquid, is moved to a sealing device, in which the entrance is sealed.

8. The method as claimed in claim 1, wherein the entrance is provided by a port, wherein the port is shut off by two opposing foil walls of the packaging being clamped shut around a welded region of the port.

9. The method as claimed claim 1, wherein the packaging, after having been filled with the liquid, is moved to a seal and is sealed by mounting of the seal onto the port, and/or in that the port and/or the seal, prior to and/or upon the mounting of the seal, is gassed with a protective gas.

10. The method as claimed in claim 1, wherein, after the packaging has been filled with the liquid up to sealing of the entrance by mounting of the seal, the entrance of the packaging is shut off, and/or in that the entrance, at least from the filling of the packaging with the inert gas up to the filling with the liquid, is provided in the protective atmosphere.

11. The method as claimed in claim 1, wherein the packaging is filled in hanging suspension, and/or in that the packaging, prior to being filled, under the application of a vacuum is checked for leak-tightness.

12. The method as claimed in claim 1, wherein after the filling of the packaging, liquid present at a liquid nozzle is withdrawn, and/or in that the liquid is withdrawn such that, after the withdrawal of the liquid, a rim of the liquid nozzle is still in contact with the liquid, and/or in that the liquid nozzle is blown against from below with a protective gas.

13. The method as claimed in claim 1, wherein the liquid is an oxygen-sensitive medical liquid to be administered intravenously, and/or in that the gas volume in the sealed packaging has an oxygen content of less than 1% by volume, and/or in that the packaging is enclosed and thermally sterilized with a secondary packaging comprising an oxygen barrier.

14. A device for a method for filling a medical packaging configured as a pouch, as claimed in claim 1, comprising a filling head having a gas nozzle for feeding an inert gas into the packaging and having a liquid nozzle for filling the packaging, wherein at least one opening for the provision of a protective atmosphere extends, at least in some sections, around the liquid nozzle and/or the gas nozzle.

15. The device as claimed in claim 14, wherein extending around the liquid nozzle and/or the gas nozzle are a plurality of openings for the provision of the protective atmosphere, wherein the openings extend in a circle around the gas nozzle and/or the liquid nozzle.

16. The device as claimed in claim 14, wherein the gas nozzle and/or the liquid nozzle is or are arranged in a depression, wherein the gas nozzle and/or the liquid nozzle has or have an opening distanced from a rim of the depression, and/or in that the liquid nozzle and/or the gas nozzle protrudes or protrude within the depression, wherein the opening is arranged around the protruding liquid nozzle and/or the protruding gas nozzle.

17. Use of a device as claimed in claim 14 for filling a medical packaging configured as a pouch.

18. A pharmaceutical product comprising a medical packaging configured as a pouch, producible or produced with a method as claimed in claim 1, wherein the medical packaging is filled with a liquid containing an active agent or with a liquid for parenteral feeding, and has a gas volume which has an oxygen content of less than 1% by volume.

19. The pharmaceutical product as claimed in claim 1, wherein the packaging is arranged in a secondary packaging comprising an oxygen barrier.

20. The pharmaceutical product as claimed in claim 19, wherein the oxygen barrier is a metal foil.

* * * * *